US005826639A

United States Patent [19]

Miller

[11] Patent Number: 5,826,639

[45] Date of Patent: Oct. 27, 1998

[54] REVERSIBLE ARCUATE PANEL DEVICE

[75] Inventor: Melvin M. Miller, Bloomington, Ind.

[73] Assignee: Channel-Kor System Inc., Bloomington, Ind.

[21] Appl. No.: 944,050

[22] Filed: Sep. 12, 1997

Related U.S. Application Data

[63] Continuation-in-part of Ser. No. 358,806, Dec. 13, 1994, abandoned, which is a continuation-in-part of Ser. No. 88,069, Jul. 6, 1993, abandoned.

[51] Int. Cl.[6] ..... A47G 5/00

[52] U.S. Cl. ..... 160/135; 160/352

[58] Field of Search ..... 160/135, 351, 160/352, 132, DIG. 7; 40/605, 606, 610, 615, 603; 52/239, 36.1; 211/195

[56] References Cited

U.S. PATENT DOCUMENTS

| | | | |
|---|---|---|---|
| 2,266,854 | 12/1941 | Davis | 160/352 |
| 3,319,801 | 5/1967 | Nordstrom | 160/135 |
| 4,865,111 | 9/1989 | Perutz | 160/135 |
| 4,924,931 | 5/1990 | Miller | 160/135 |
| 4,979,554 | 12/1990 | Nelson | 160/135 |
| 5,048,585 | 9/1991 | Miller | 160/135 |
| 5,092,385 | 3/1992 | Beaulieu | 160/135 |

*Primary Examiner*—David M. Purol
*Attorney, Agent, or Firm*—Donald R. Bahr

[57] ABSTRACT

This invention is concerned with a panel device which is useful in the display and furniture arts, the panel device incorporates a plurality of vertical supports which engage a plurality of panel members which are positioned in a planar relationship with each other, further the vertical supports are adapted to receive arcuate panel members, the planar and arcuate panels as used may be readily detached from each other, the planar panel members are pivotally attached to each other, the arcuate panel has two display surfaces, the arcuate panel may be readily converted from an arcuate to a flat stance for storage, further the planar and arcuate panels may be folded one on each other for storage, the arcuate panel section may be bent in either of two directions so as to provide a choice of either side to be utilized as the "showside" display surface.

23 Claims, 6 Drawing Sheets

FIG. 10
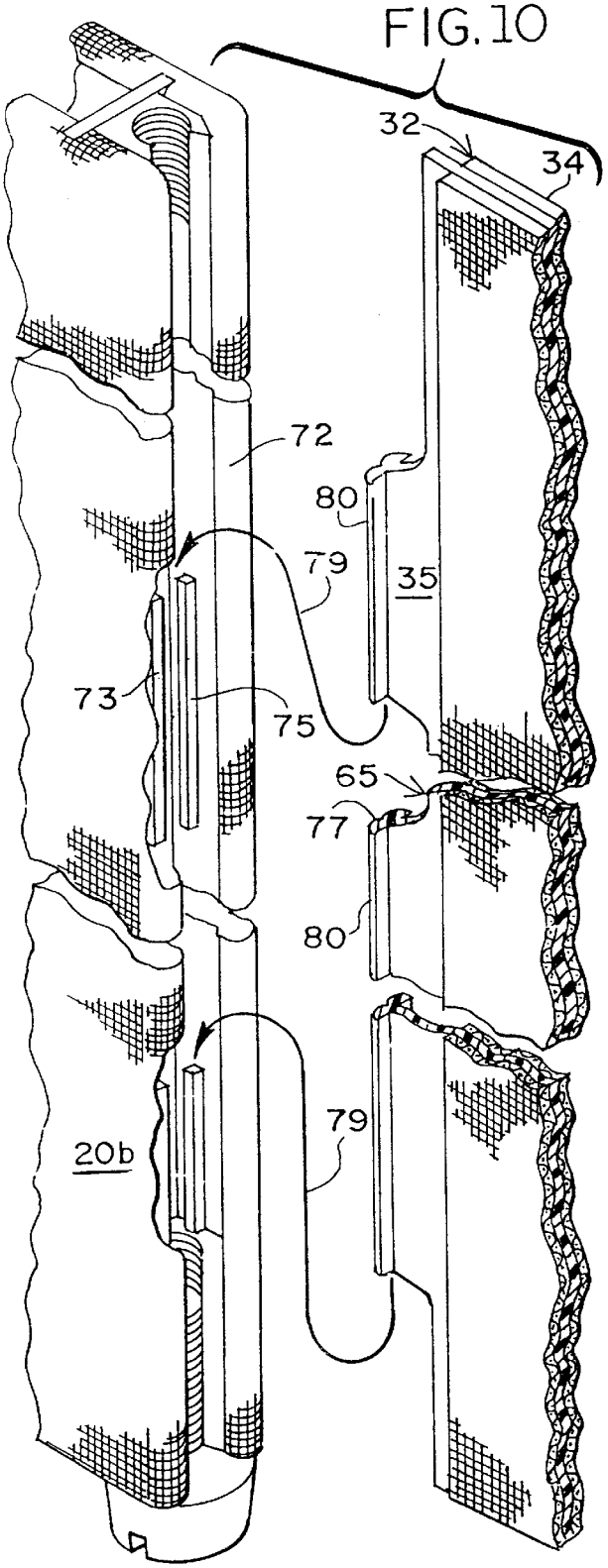
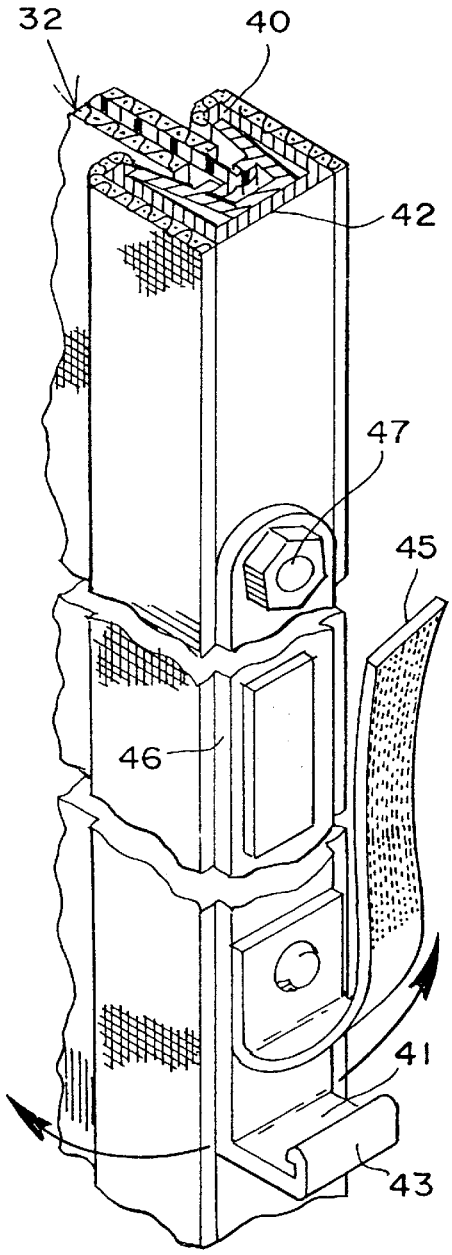
FIG. 5

REVERSIBLE ARCUATE PANEL DEVICE

RELATED APPLICATION

This application is a continuation in part application of application Ser. No. 358,806 filed Dec. 13, 1994 now abandoned which is in turn a continuation in part application of application Ser. No. 088,069 filed Jul. 6, 1993, now abandoned.

FIELD OF THE INVENTION

This invention is concerned with portable, flexible, panel devices which can be used to display information at trade shows and conventions. Panel devices as are used at trade shows or conventions are of two principal types, these being the large bulky type and the portable type. This invention is concerned with the portable type. Portable display devices have become very popular in recent years for utilization at regional trade shows and conventions, these portable display devices, when assembled, present a nice impression and have a very high display surface to weight ratio. Further, these portable display devices are advantageous in that they can be quickly and easily assembled and disassembled without tools by one person. In contrast, the large bulky display devices as mentioned above are very heavy and hence have a low display surface to weight ratio. Further, these display devices can be assembled only with great difficulty by extra workmen at great expense.

The subject invention is useful in connection with portable display devices wherein a plurality of display panels are attached to channels which in turn function as supporting means. It is often desirable to locate the panels of a display device in angular relationship with each other. Further, it is desirable to have a display device which incorporates both planar and arcuate panels. It is in this area where the subject invention is useful. This invention is concerned with a panel device which incorporates arcuate panels which may be used in conjunction with planar panels. The arcuate panels give the resulting composite structure a soft appearance and added stability.

This invention also includes a connector system whereby an arcuate panel section may be attached to a planar panel device.

Planar display devices are very common in the prior art. Typically, these prior art display devices comprise a plurality of panels which are positioned in one or more planes. In order to present a pleasing and varied appearance, it is desirable that portable display devices incorporate both planar and arcuate panels.

Further, it is desirable to have a panel device with both planar and arcuate panels wherein the two types of panels can be readily attached to and separated from each other.

Accordingly, it is an object of this invention to provide a panel device having both planar and arcuate panels.

It is a further object of this invention to provide a panel device wherein the planar and arcuate panels can be readily attached and detached from each other.

Likewise, it is an object of this invention to provide an arcuate panel which can be readily converted from an arcuate stance to a flat stance for shipping.

It is also an object of this invention to provide an arcuate panel that can be removed and reversed to allow the utilization of the both sides of the display panel.

These objects and advantages should be construed as merely illustrative of some of the more prominent features and applications of the present invention. Many other beneficial results can be obtained by applying the disclosed invention in a different manner or by modifying the invention within the scope of the disclosure. Accordingly, other objects and advantages as well as a fuller understanding of the invention may be had by referring to the summary and detailed description of the preferred embodiment of the invention in addition to the scope of the invention as defined by the claims taken in conjunction with the accompanying drawings.

SUMMARY OF THE INVENTION

The present invention is defined by the appended claim with the specific preferred embodiment shown in the attached drawings. For the purpose of summarizing the invention, the invention may be defined as a panel device which has both planar and arcuate sections. The planar panels are pivotally attached to each other. The arcuate panels are preferably, but not necessarily, detachably attached to the end planar panels. The arcuate panel is of such a structure that it can be readily converted from an arcuate stance to a planar stance. The ability to convert panels form an arcuate stance to a planar stance is very useful, as in the planar stance the panel can be readily stored for shipment.

The arcuate panel of the subject invention can be quickly and easily attached and detached from the planar segment of the overall panel device. This is a useful feature of the subject invention as the arcuate and planar panels can be interchanged at will to allow reconfiguration of the composite structure. This feature is likewise useful in that it allows the planar and arcuate panels to be stored separately for shipment. The arcuate panel can be reversed to allow either side of the panels to function as an arcuate display surface.

The foregoing has outlined rather broadly the more pertinent and important features of the present invention in order that the detailed description of the invention that follows may be better understood whereby the present contribution to the art may be more fully appreciated. Additional features of the invention will be described hereinafter which form the subject of the claims of the present invention. It should be appreciated by those skilled in the art, that the conception and the specific embodiment disclosed herein may be readily utilized as a basis for modifying or designing other apparatus for carrying out the same purposes of the present invention. It should also be realized by those skilled in the art that such equivalent apparatus does not depart from the spirit and scope of the invention as set forth in the appended claims.

DESCRIPTION OF THE DRAWINGS

FIG. 5 is an enlarged fragmentary isometric view of the end of the arcuate panel;

FIG. 10 is a perspective view showing a method for attaching an arcuate panel to a vertical panel;

DESCRIPTION OF THE PREFERRED EMBODIMENT

The subject invention relates to a panel device which comprises a plurality of vertical supports which are secured in parallel relationship with each other. Spaced between the vertical supports are planar panels. Arcuate panels are attached to the end planar panels. Arcuate panels are attached to the end planar panels in order to give the finished panel device a soft look. The parallel relationship of the vertical supports may be further defined by the interconnecting horizontal supports. The combination of the vertical supports and horizontal supports define a form which may be square or rectangular. Secured within each frame so defined is a planar panel member.

As is mentioned herein above, the subject device is particularly useful in the portable display arts. It should be noted, however, that the panel device of this invention is also useful in the furniture arts. The subject panel device can be fabricated in such a size that it can be used for example, as a room divider, office separator, privacy screen or noise barrier. In the furniture arts the panel device at hand is particularly useful in that the various panels can be angularly disposed in relation to each other to define any given surface area. The arcuate panels give the overall structure a pleasing soft appearance. If so desired, the planar and arcuate panel members can be locked into a fixed relationship with each other.

Figure 1:
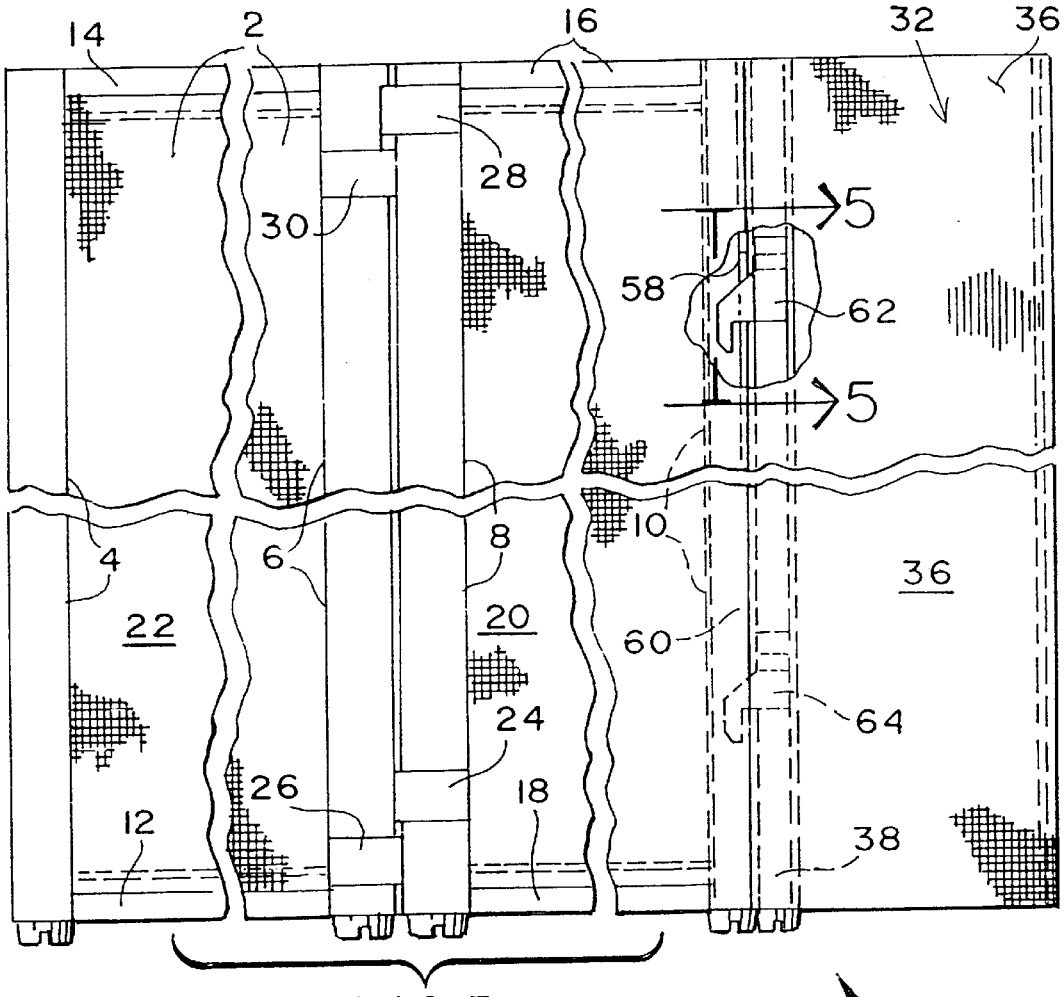
FIG. 1 is a fragmentary front view of the panel device of this invention.
Figure 4:
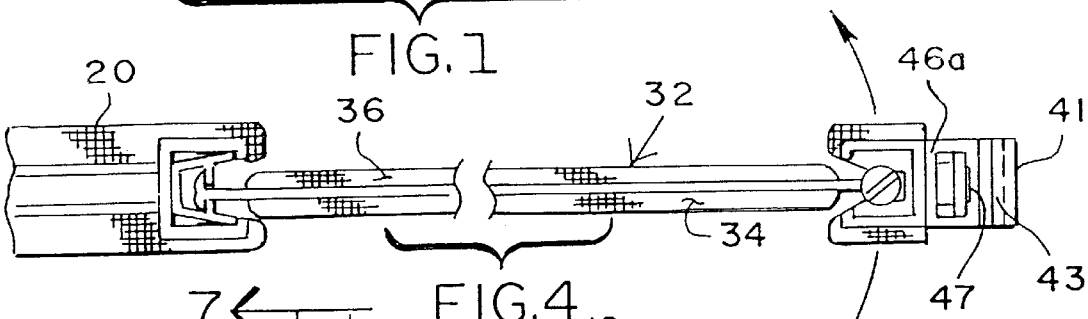
FIG. 4 is a fragmentary plan view of the arcuate panel.

Referring to FIG. 1, it can be seen that the panel device 2 of this invention in part comprises vertical supports 4, 6. 8 and 10, horizontal supports 12, 14, 16, and 18 and planar panels 20 and 22.

Figures 2, 3:
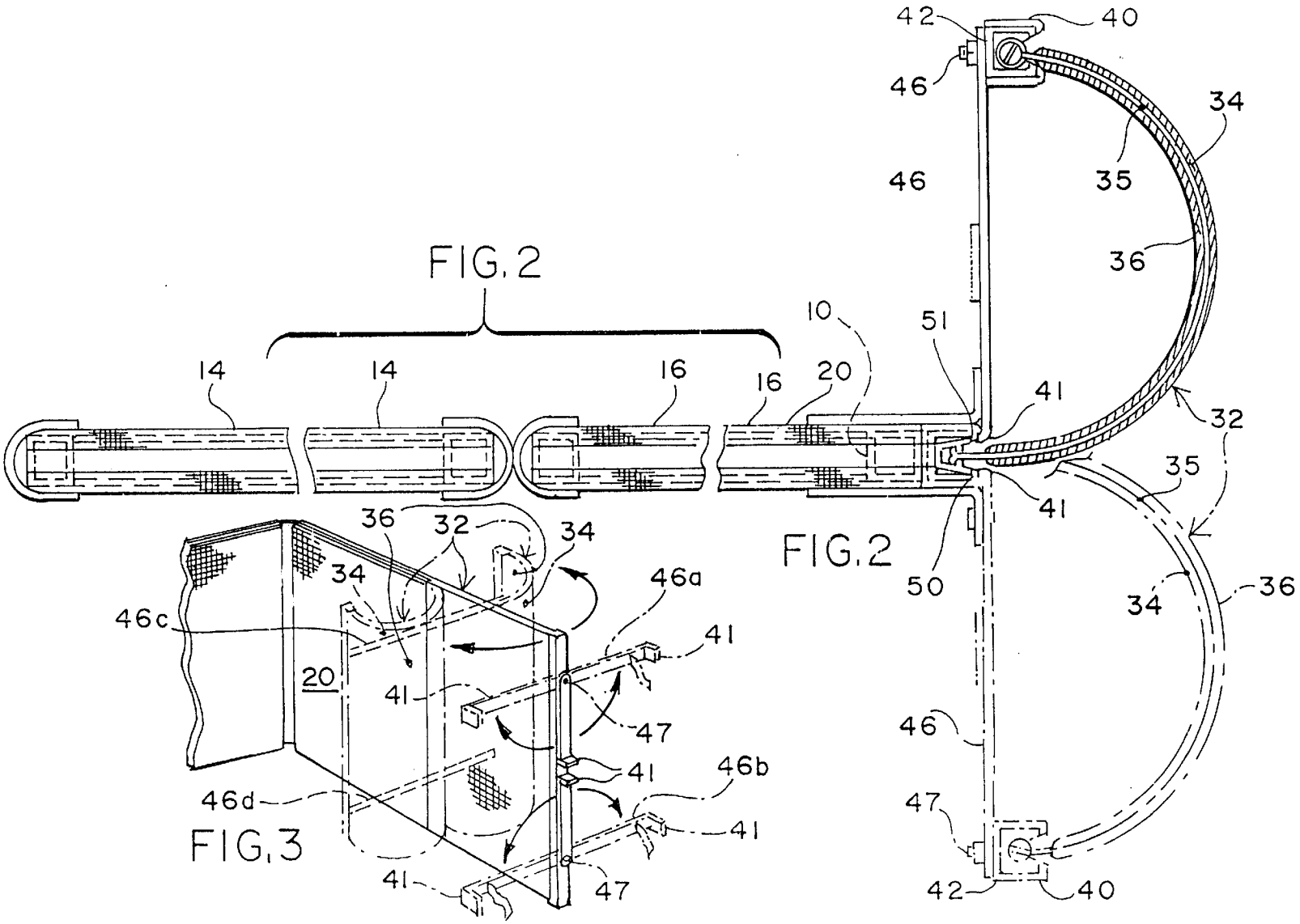
FIG. 2 is an enlarged fragmentary plan view of the panel device showing an alternate position of the arcuate panel in phantom lines.
FIG. 3 is a perspective view of the panel device of this invention showing the arcuate panel in phantom lines.

As is shown in FIGS. 1 and 2, in accordance with the preferred embodiment, pairs of adjacent vertical supports 6 and 8 are rotatably connected to each other via a plurality of strap hinge elements 24, 26, 28, and 30. It is understood by one skilled in the art that the vertical supports of the panel device of this invention can be easily attached to each other by any convenient connecting means.

From FIGS. 1, and 2, it can be seen that panels 20 and 22 are planar. Panel devices with planar panels are very common in the prior art and, in fact, at the present time, they are the state of the art particularly in panel devices which are used as portable displays. The panel device of this invention further incorporates an arcuate panel member 32 which gives overall panel device 2 a very pleasing esthetic appearance and added stability. It is this arcuate panel device with which this invention is primarily concerned. In particular, this invention is concerned with the fact that both sides of arcuate panel member 32 can alternately be used for display purposes and that arcuate panel member 32 can be reversed so as to allow it to be positioned on either side of the planar segments of panel device 2.

Arcuate panel member 32 may be detachedly connected to planar panel section 20 by means which will be described in detail herein below. It is understood by one skilled in the art, that arcuate panel member 32 need not by detachedly connected to planar panel 20. Because it is desirable to store arcuate panel member 32 separately, it is preferred that it be detachedly connected to the planar panel section 20 of the subject panel device.

From FIG. 2, it can be seen that arcuate panel member 32 incorporates two display surfaces 34, 36 and a flexible intermediate layer 35. Panel 32 is flexible and is adapted to be bent into an arcuate shape. The terminal ends of arcuate panel member 32 are attached to vertical supports 38 and 40. Vertical support 38 is in turn detachedly connected to vertical support 10 of panel section 20. Vertical supports 38 and 40 are covered with the same materials as are surfaces 34 and 36 to provide visually pleasing transitions between flat panel 20 and curve member 32.

Display surfaces 34 and 36 may be of different colors and textures in order to give arcuate panel section 32 maximum esthetic flexibility. The terminal edge 42 of vertical support 40 incorporates fastening means whereby arcuate panel 32 can be drawn into and retained in an arcuate stance, bar 46 being shown in FIG. 2 and a pair of fasteners 46*a* and 46*b* being shown in FIG. 3.

While any convenient fastening means can be used to attach edge 42 of vertical support 40, to vertical support 38 it has been found that a bar 46 with a hook end 41 is ideally suited for this application. Hook end 41 may be further inserted between panel 32 and second vertical supported 38. The operation of this fastening means 46 is further illustrated in FIG. 11.

FIGS. 1 to 3 show arcuate panel member 32 in a set up stance. From FIG. 2, it can be seen that arcuate panel 32 has a pleasing curved outer face. Further from FIG. 2, it can be seen that arcuate panel 32 can be reversed so as to expose display surface 36. FIGS. 2 and 3 also show arcuate panel 32 attached to planar panel member 20. When arcuate panel 32 is in a flat stance, it may be detached from panel member 20 as will be described herein below. Once this detachment is effected, panel members 20 and 22 can be folded upon each other. After removal from panel member 20, arcuate panel member 32 is then flattened and then placed on top of folded up panel member 20 and 22 and both may be placed in a suitable shipping container.

To set up the panel members device of this invention, one opens up and folds outwardly panels 20 and 22. Arcuate panel 32 is then attached to panel member 20. Arcuate panel 32 is then bent into an arcuate stance so as to reveal surface 34 or 36 and retained in this stance by securing fastening means 46*a* and 46*b*, between first and second vertical supports 38 and 40. Fastening means 46*a* and 46*b* are secured to vertical support 38 by the placement of hooks 41, as shown in FIG. 2, between panel member 32 and lips 50 and 51 of vertical support 38.

As is shown in FIGS. 13, 14, 15, 16 and 17 a plurality of other fastening means may be used. In the preferred embodiment two fastening means such as 46*a* and 46*b* are utilized per arcuate panel as is shown in FIG. 3.

Figure 9:
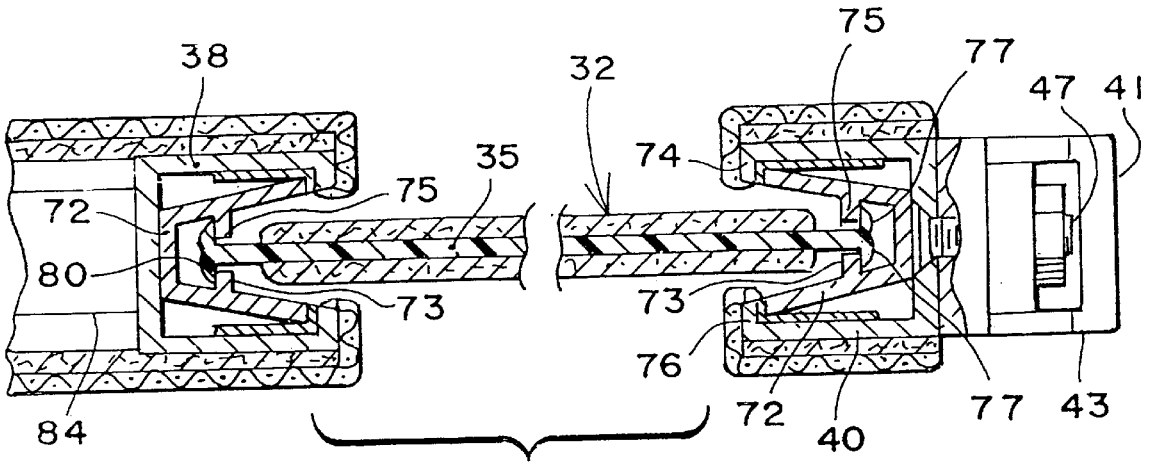
FIG. 9 is an enlarged vertical view showing an arcuate panel connection to a vertical panel.

In the preferred embodiment of this invention, vertical supports 38 and 40 are U-shaped channels with an inner spline 72 with retainer lips 73 as shown in FIG. 9 which are adapted to receive arcuate panel 32. It is understood by one skilled in the art, that vertical supports 38 and 40 can assume other configurations.

In order to provide for versatility, arcuate panel 32 is provided with two display surfaces 34 and 36 which may be different color and/or terxtures. This reversal is accomplished by providing 180 degree of pivotal movement in fastening means 46*a* and 46*b,* as is shown in FIGS. 2 and 3. That is, in this invention, in the embodiment as illustrated in FIG. 3 fastening means 46*a* and 46*b* may be rotated 180 degrees in a plane which is parallel with the axis of vertical supports 38 and 40.

As is shown in FIG. 2, the attachment of fastening means 46 to vertical support 42 is effected via screw 47 or an equivalent fastener. As can be seen, fastening means 46 is free to rotate 360 degrees around screw 47 in a plane which is parallel to the axis of vertical support 42.

Figure 6:
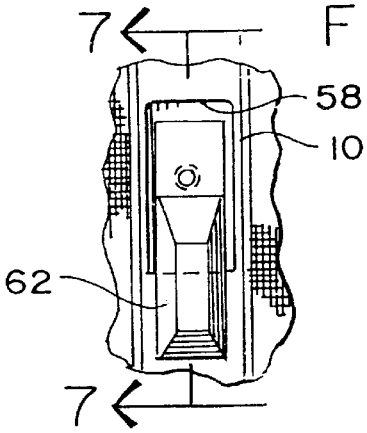
FIG. 6 is an enlarged panel connector, taken on the line 5—5 of FIG. 1.
Figure 7:
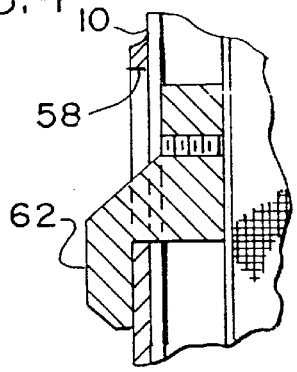
FIG. 7 is a fragmentary vertical sectional view, through the connector, taken on the line 7—7 of FIG. 6.

FIGS. 1, 6, and 7 show the details of one way the arcuate panel section 32 may be attached and detached to planar panel section 20. Vertical support 10 is provided with a plurality of rectangular apertures 58 and 60 which give access to the hollow interior of vertical support 10. Vertical support 38 is in turn provided with a plurality of hooks 62 and 64 which correspond and cooperate with rectangular apertures 58 and 60. Hooks 62 and 64 are biased into a locking relationship with apertures 58 and 60 by friction and gravity. Hooks 62 and 64 are in turn attached to vertical supports 10 with suitable fasteners such as set screws. In order to effect disassembly of display 2, arcuate panel 32 is lifted vertically causing hooks 62 and 64 to disengage from rectangular apertures 58 and 60 thereby causing arcuate panel 32 to disengage from planar panel 20.

For the reasons as set forth herein, the subject invention results in a superior arcuate panel device that has two sided utilization.

Figure 8:
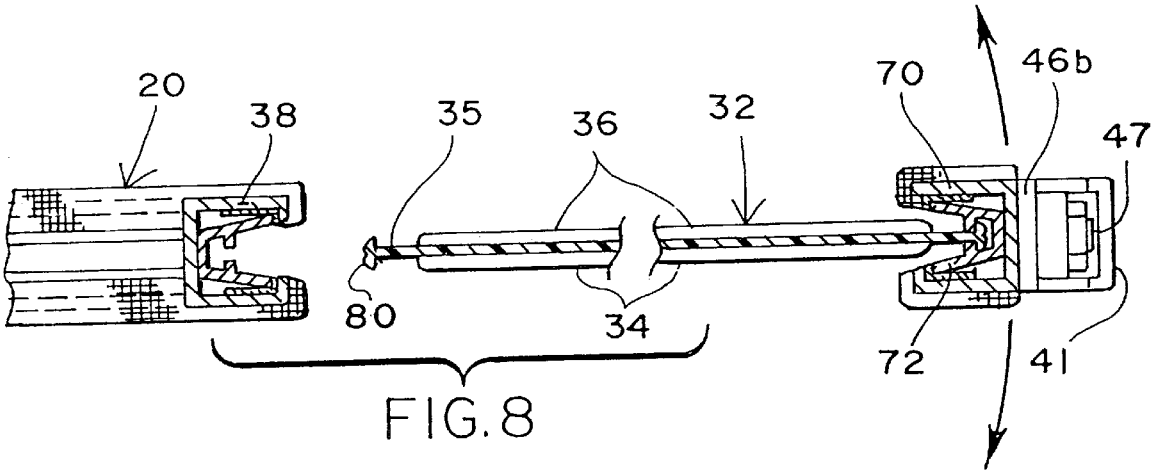
FIG. 8 is a fragmentary for plan view showing the arcuate panel in an alternate mode disconnected from the planar panel.

FIGS. 8 to 10 discloses another embodiment of this invention wherein the vertical supports 38 are shown as intregal part of panel 20 as second vertical support that comprises a vertical support for a planar panel section. In this embodiment display panel 32 has two display surfaces 34 and 36. Display panel 32 is secured in a first vertical means 77 which engages lips 74 and 76 which are integral with first vertical support 40. The opposite edge of display panel 32 incorporates an intermittent T shaped locking means 80 which engages locking spline 72 which is in turn secured to vertical support 38 which also functions as a vertical support for planar panel 20. Vertical support 38 is secured in a routed out section 83 of planar panel 20. In this embodiment vertical support 82 has a dual function in that it functions as a vertical support for planar panel 84 and as a support for arcuate display panel 32.

As can be seen in FIG. 10 locking spline 72 has voids in its locking lips 73 and 75 which receive the intermittent T shaped beads of locking means 80. Locking is effected when the intermittent T shaped locking means 80 is inserted into voids of locking spline 72 and slid vertically in the direction of arrow 79 so as to lock lips 80 into locking channel 72.

Figure 12:
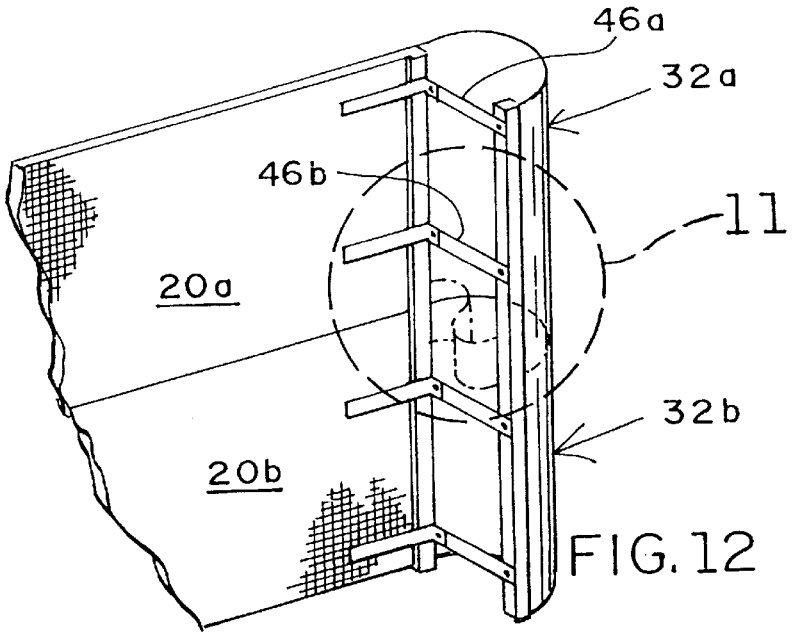
FIG. 12 is a perspective view showing the joining of a stacked pair of planar panels and a pair of arcuate panels in accordance with this invention.
Figure 11:
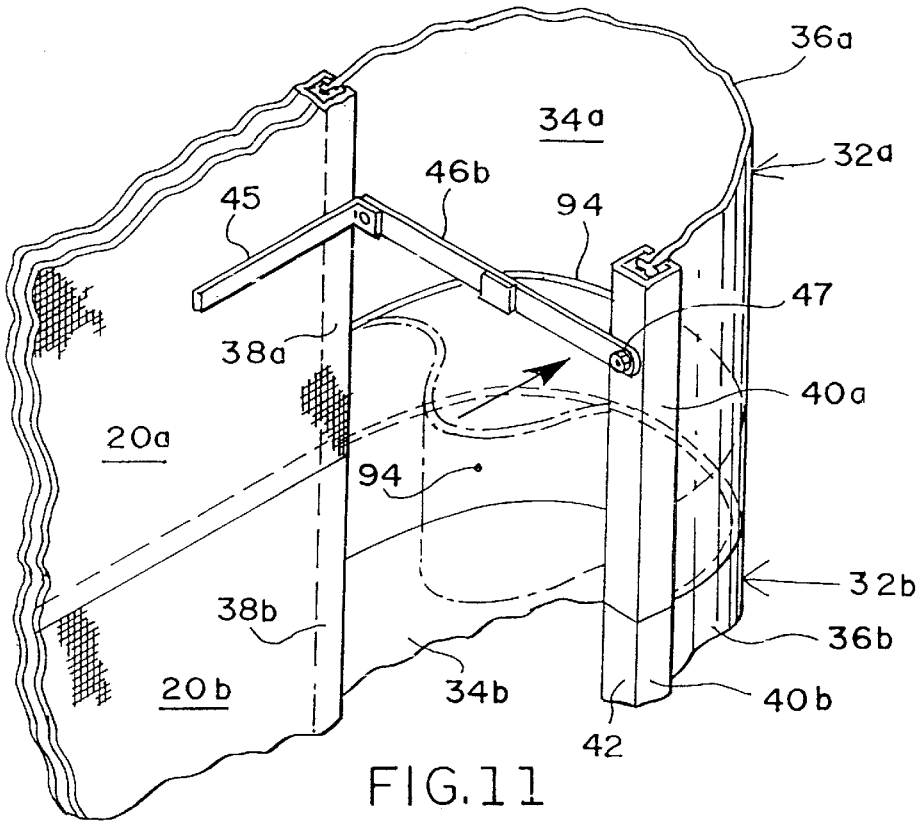
FIG. 11 is a fragmentary symmetric view of the arcuate panel of this invention.

FIGS. 11 and 12 shows still another embodiment of this invention wherein a curve stabilizer 94 is placed on the inner side of a pair of locked arcuate panel sections 32*a* and 32*b* in order to enhance the registration of the front curved surfaces 36*a* and 36*b* of arcuate panel sections 32*a* and 32*b*. In this structure a curve stabilizer 94 is biased between first and second vertical supports 38*a* & 38*b*, and 40*a* & 40*b*. Stabilizer 94 is formed from a flexible sheet material. Curve stabilizer 94 must be of sufficient resiliency to bias the back sides 34*a* and 34*b* of curved panel sections 86 and 88 into registration with each other. As is shown in FIG. 11 curve stabilizer 94 must be of the proper length to bias it between first and second vertical supports 38*a* and 38*b*, and 40*a* and 40*b*. A width of from about 4 to 6 inches has been found to be optimum for curve stabilizer 94. Stabilizer 94 must be of a removable type so that it can be re-inserted when curve is reversed to allow surfaces 34*a* and 34*b* to become the visible useful "Show side" surface.

FIGS. 13, 14, 15, 16 and 17 disclose alternate structure wherein arcuate panel 32 may be locked into an arcuate stance.

Figure 13:
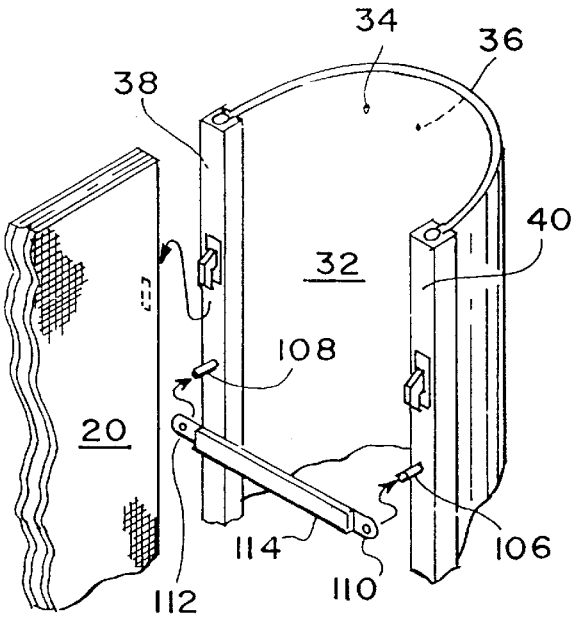
FIGS. 13 to 17 are isometric views showing alternate means for securing the arcuate panel of this invention in an arcuate stance.

From FIG. 13 it can be seen that vertical supports 38 and 40 incorporate a pair of opposing projections 106 and 108 which are adapted to receive apertures 110 and 112 which are integral with locking bar 114. Projections 106 and 108 may be undercut in order to assist in the retention of aperture 110 and 112 and hence locking bar 114 onto projections 106 and 108.

Figure 14:
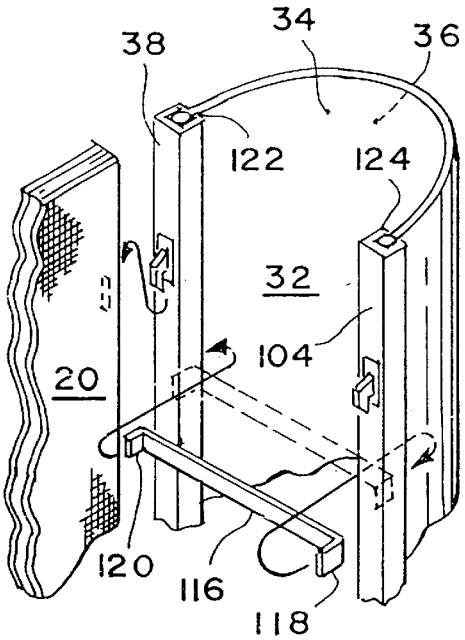

Further from FIG. 14 it can be seen that arcuate panel 32 may be locked into an arcuate stance by the use of locking bar 116 which incorporates a pair of undercut projections 118 and 120 which are biased between arcuate panel 32 and the inner edges of vertical supports 38 and 40. When locking bar 116 is biased between arcuate panel 32 and the inner edges of vertical supports 38 and 40 the undercuts of projections 118 and 120 engage lips 122 and 124 which are integral with vertical supports 38 and 104.

Figure 15:
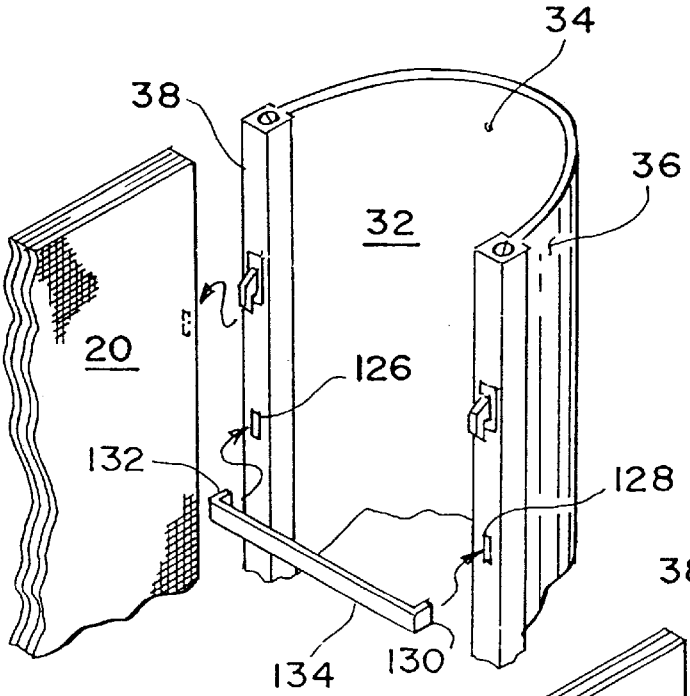

FIG. 15 illustrates that vertical supports 38 and 40 may by provided with a pair of opposing apetures 126 and 128 which are adapted to receive and engage projections 130 and 132 which are integral with locking bar 134.

Figure 16:
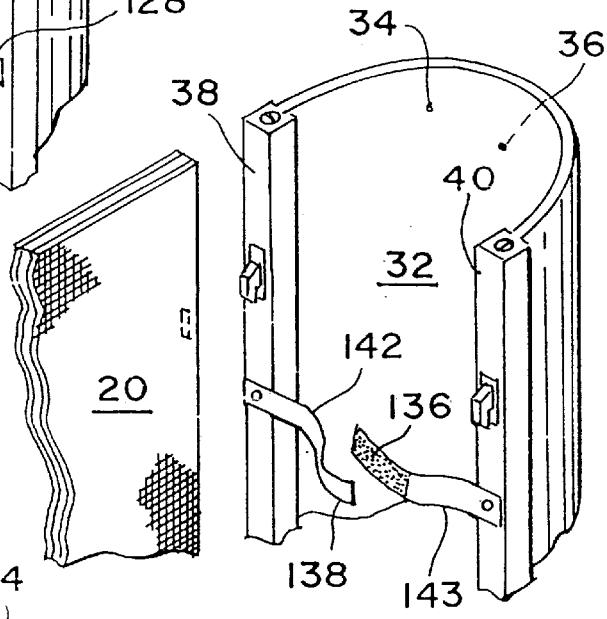

FIG. 16 shows still another method wherein arcuate panel 32 may be biased in an arcuate stance via a pair of straps 132 and 134 which are pivotely attached to vertical supports 38 and 40. The terminal ends 136 and 138 of straps 132 and 134 are provided with opposing hook and loop fasteners whereby the terminal ends 136 and 138 of straps 132 and 134 may be secured to each other thereby biasing arcuate panel 32 in an arcuate stance. It is understood by one skilled in the art that means other than a hook and loop fastening system may be used to secure the terminal ends of straps 132 and 134 to each other.

Figure 17:
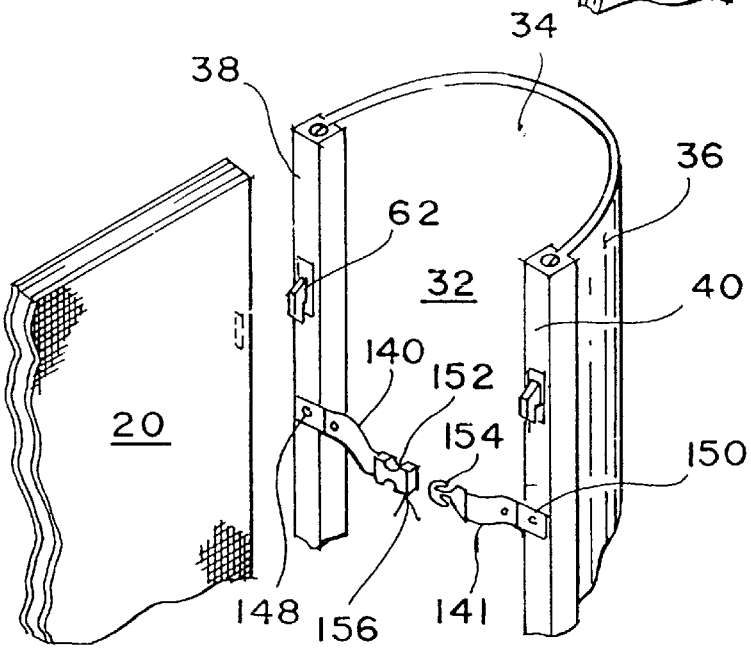

FIG. 17 shows such an alternate embodiment wherein a pair of straps 140 and 142 are used to bias the panel section together. As illustrated on end of the four strap segments 148 and 150 are attached to vertical supports 38 and 40. The ends of strap segments 148 and 150 opposite vertical supports 38 and 40 have attached there to male 152 and female 154 components of fastener 156. When female component 154 is secured into male component 152 arcuate panel 32 is biased in an arcuate stance.

Further from the drawings it is obvious that the alternate display surfaces as presented by the arcuate panels of this invention are smooth and continuous and they do not have projections or extraneous hardward projecting from these surfaces.

Vertical supports 38 and 40 are described in a plurality of embodiments herein above. In the preferred embodiment of this invention the outer exposed surfaces of vertical supports 38 and 40 are covered with the same material which comprises the outer surfaces of display surfaces 34 and 36.

The above description and drawings are illustrative only since modifications can be made without departing from the present invention, the scope of which is to be limited only by the following claims.

What is claimed is:

1. An improved arcuate portable display panel section having a pair of opposing first and second vertical supports, a three layer panel being interconnected between said first and second vertical supports, wherein the improvement comprises:

said panel having a first layer which comprises a display surface, an intermediate layer and a third layer which comprises an alternative display surface so as to form first and second display surface, wherein said display panel incorporates a fastening system which is capable of biasing said panel in an arcuate stance in a first plane so as to expose said first display surface and said fastening system is capable of biasing said panel in an arcuate stance in a second plane when said panel is rotated 180 degrees so as to expose said second display surface.

2. The arcuate display panel section of claim 1 wherein said fastening system comprises a pair of straps each having one end which is attached to said first and second vertical supports and the other ends having means whereby they may be attached to each other.

3. The arcuate display panel section of claim 1 wherein said fastening system comprises a strap having one end which is attached to said first vertical support, the other end of said ribbon having means whereby it may be attached to the second vertical support.

4. The arcuate display section of claim 1 wherein said fastening system is a bar, one end of which is pivotly attached to said first vertical support, the other end incorporating a means whereby it may be attached to said second vertical support.

5. The arcuate display panel section of claim 2 wherein the means for attaching the straps to each other comprises a section of a hook and loop fastener, which is secured to the ends of said pair of straps.

6. The arcuate display panel section of claim 3 wherein the means for attaching the ends of the strap fastening system to the second vertical support comprises a hook which is attached to the end of the strap.

7. The arcuate display panel section of claim 4 wherein the means for attaching the end of said bar to the second vertical support comprises a section of a hook and loop fasteners one portion of which is attached to the terminal end of said bar the other portion being attached to the second vertical support.

8. The arcuate display panel section of claim 4 wherein the means for attaching the end of the bar to the second vertical support comprises a hook which is integral with said bar.

9. The arcuate display panel section of claim 1 wherein the first and second vertical supports are U-shaped channels and wherein said second vertical support is attached to and functions as a vertical support for a planar panel, wherein, said U shaped channels are adapted to receive display panels.

10. The arcuate display panel section of claim 2 wherein the first and second vertical supports are U-shaped channels and wherein said second vertical support is attached to and functions as a vertical support for a planar panel, wherein, said U shaped channels are adapted to receive display panels.

11. The arcuate display panel section of claim 3 wherein the first and second vertical supports are U-shaped channels and wherein said second vertical support is attached to and functions as a vertical support for a planar panel wherein, said U-shaped channels are adapted to receive display panels.

12. The arcuate display panel section of claim 4 wherein the first and second vertical supports are U-shaped channels and first and second vertical supports are U-shape channels and wherein said second vertical support is attached to and functions as a vertical support for a planar panel, wherein, said U-shaped channels are adapted to receive display panels.

13. The arcuate display panel section of claim 5 wherein the first and second vertical supports are U-shaped channels and wherein said second vertical support is attached to and functions as a vertical support for a planar panel, wherein, said U-shaped channels are adapted to receive panels.

14. The arcuate display panel section of claim 6 wherein the first and second vertical supports are U-shaped channels and wherein said second vertical support is attached to and functions as a vertical support for a planar panel, wherein, said U-shaped channels are adapted to receive display panels.

15. The arcuate display panel section of claim 1 wherein at least one of said first and second vertical supports is provided with a means for connecting said arcuate display panel section to an adjacent flat panel section.

16. The arcuate display panel section of claim 4 wherein at least one of said first and second vertical supports is provided with a means for connecting said arcuate display panel section to an adjacent flat panel section.

17. The arcuate display panel section of claim 1 wherein said panel has inner and outer display surfaces which may be of different colors or textures.

18. The arcuate display panel section of claim 3 wherein said panel has inner and outer display surfaces which may be of different colors or textures.

19. The arcuate display panel section of claim 14 wherein said panel has inner and outer display surfaces which may be of different colors or textures.

20. The arcuate display panel section of claim 1 wherein said fastening system comprises at least two pairs of straps each strap having one end which is attached to said first and second vertical supports and the other ends having opposing male and female fastener components attached thereto, wherein when said male and female components are secured together said display panel section is biased in an arcuate stance.

21. The arcuate display panel section of claim 20 wherein the male and female fastener components comprise a fastener and wherein two pairs of straps are used on each panel section.

22. The arcuate display panel section of claim 1 wherein at least two of said panel sections are stacked one on each other and wherein a section of a flexible sheet is positioned on the backside of said arcuate panel section at the horizontal junction of said panel sections said flexible sheet biasing the display surfaces of said panel section so that they register with each other.

23. The arcuate display panel section of claim 22 wherein the terminal edge of said flexible sheet are biased between said first and second vertical supports.

* * * * *